US012601076B2

(12) United States Patent
Perroni et al.

(10) Patent No.: US 12,601,076 B2
(45) Date of Patent: Apr. 14, 2026

(54) IMPURITY CONTROL IN LITHIUM RECOVERY

(71) Applicant: Schlumberger Technology Corporation, Sugar Land, TX (US)

(72) Inventors: Dominic Vincent Perroni, Sugar Land, TX (US); Florence Binet, Houston, TX (US); Prasanna Nirgudkar, Sugar Land, TX (US); Rod William Shampine, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 503 days.

(21) Appl. No.: 18/311,325

(22) Filed: May 3, 2023

(65) Prior Publication Data

US 2023/0357942 A1 Nov. 9, 2023

Related U.S. Application Data

(60) Provisional application No. 63/364,072, filed on May 3, 2022.

(51) Int. Cl.

| | |
|---|---|
| ***C25C 3/02*** | (2006.01) |
| ***C25C 1/02*** | (2006.01) |
| ***C25C 7/06*** | (2006.01) |

(52) U.S. Cl.
CPC . *C25C 1/02* (2013.01); *C25C 7/06* (2013.01)

(58) Field of Classification Search
CPC ..... C25C 1/02; C25C 7/06
See application file for complete search history.

(56) References Cited

U.S. PATENT DOCUMENTS

| | | | | |
|---|---|---|---|---|
| 4,291,001 | A | 9/1981 | Repsher et al. | |
| 9,068,247 | B2 | 6/2015 | Marston et al. | |
| 2011/0174739 | A1 | 7/2011 | Chung et al. | |
| 2018/0245180 | A1 | 8/2018 | Cheng et al. | |
| 2019/0248667 | A1 | 8/2019 | Featherstone et al. | |
| 2019/0256368 | A1 | 8/2019 | Marston et al. | |
| 2020/0047124 | A1 * | 2/2020 | Bhave | B01D 69/04 |
| 2020/0189924 | A1 | 6/2020 | Featherstone et al. | |
| 2021/0079497 | A1 | 3/2021 | Baxter et al. | |

(Continued)

FOREIGN PATENT DOCUMENTS

| | | | |
|---|---|---|---|
| AU | 2021254665 | A1 | 12/2021 |
| CN | 1511964 | A | 7/2004 |

(Continued)

OTHER PUBLICATIONS

International Search Report and Written Opinion issued in the PCT Application No. PCT/US2023/020788 dated Jul. 28, 2023, 12 pages.

(Continued)

*Primary Examiner* — Zulmariam Mendez
(74) *Attorney, Agent, or Firm* — Kyle R. Miiller

(57) ABSTRACT

Described herein are methods of recovering lithium from aqueous sources. The methods include extracting lithium from an aqueous lithium source using an extraction stage to yield a lithium intermediate; routing the lithium intermediate to a concentration stage to yield a lithium concentrate; and adjusting parameters of the ion withdrawal extraction stage to target a ratio of lithium ions to impurity ions in the lithium intermediate.

20 Claims, 1 Drawing Sheet

(56) References Cited

U.S. PATENT DOCUMENTS

| | | | | |
|---|---|---|---|---|
| 2021/0246529 | A1 | 8/2021 | Jariwala et al. | |
| 2022/0055910 | A1 | 2/2022 | Jariwala et al. | |
| 2022/0402835 | A1* | 12/2022 | Bigi | C07C 45/50 |

FOREIGN PATENT DOCUMENTS

| | | | |
|---|---|---|---|
| CN | 104313348 | A | 1/2015 |
| JP | 2018172775 | A | 11/2018 |
| RU | 2688593 | C1 | 5/2019 |
| WO | 2018190754 | | 10/2018 |
| WO | 2019160982 | A1 | 8/2019 |
| WO | 2019221932 | | 11/2019 |
| WO | 2023022627 | | 2/2023 |

OTHER PUBLICATIONS

International Search Report and Written Opinion issued in the PCT Application No. PCT/US2021/047156 dated Nov. 25, 2021, 11 pages.

International Preliminary Report on Patentability of International Patent Application No. PCT/US2021/047156 dated Mar. 2, 2023, 8 pages.

* cited by examiner

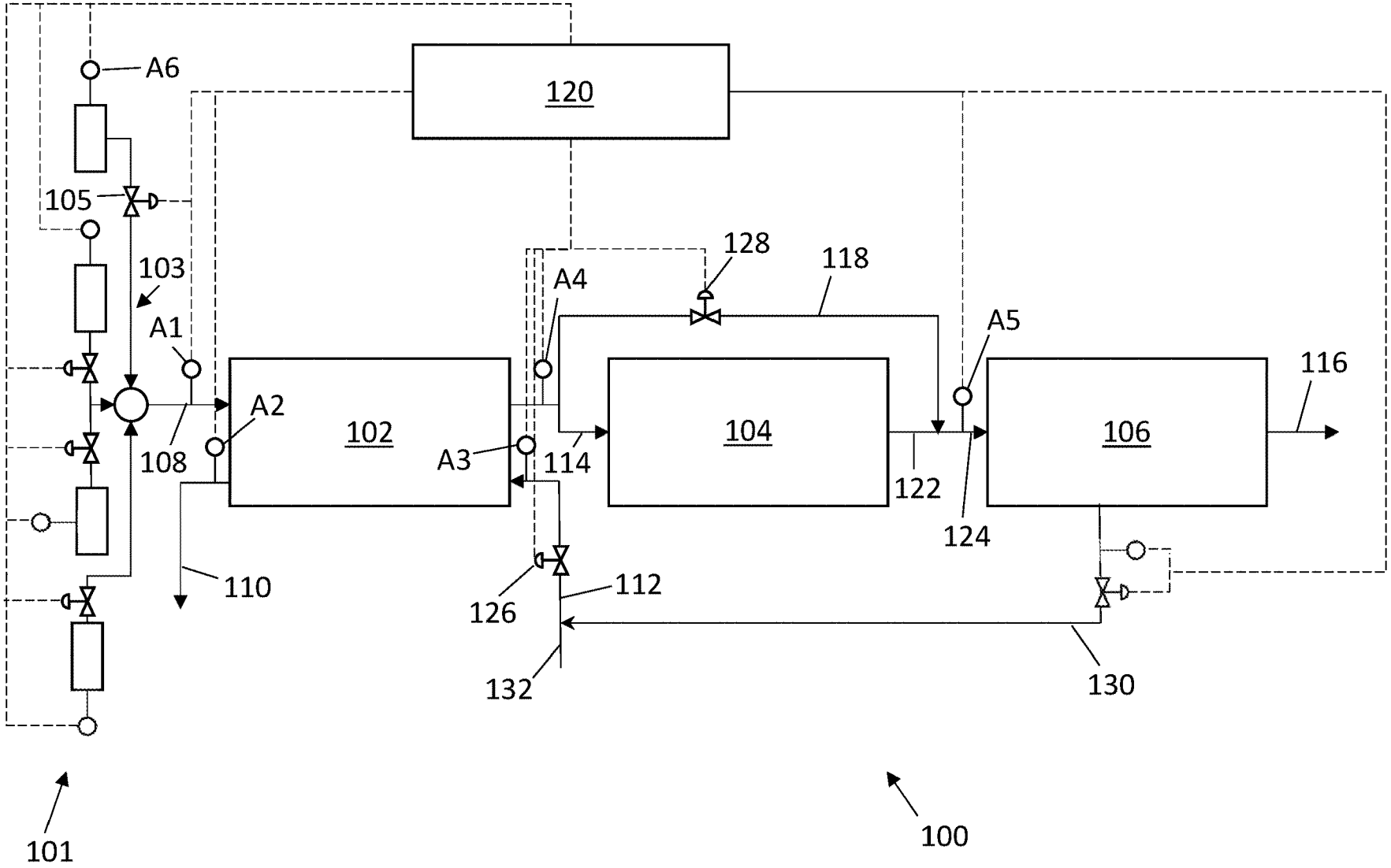
116
106
130
A5
124
122
100
118
104
128
120
112
A4
114
126
132
A3
102
A2
110
A6
103
A1
108
105
101

IMPURITY CONTROL IN LITHIUM RECOVERY

CROSS-REFERENCE TO RELATED APPLICATIONS

This application claims benefit of U.S. Provisional Patent Application Ser. No. 63/364,072 filed May 3, 2022, which is entirely incorporated herein by reference.

FIELD

This patent application describes methods and apparatus for lithium recovery from aqueous sources. Specifically, processes for managing impurities in lithium recovery processes are described.

BACKGROUND

Lithium is a key element in energy storage. Electrical storage devices, such as batteries, supercapacitors, and other devices commonly use lithium to mediate the storage and release of chemical potential energy as electrical current. As demand for renewable, but non-transportable, energy sources such as solar and wind energy grows, demand for technologies to store energy generated using such sources also grows.

According to the United States Geological Survey, global reserves of lithium total 22 million tons (metric) of lithium content, with Chile, Australia, Argentina, and China accounting for about 85% of global reserves. U.S. Geological Survey, Mineral Commodity Summaries, January 2022. According to S&P Global Market Intelligence, lithium supply is forecast to be 636 kT LCE in 2022, up from 497 KT in 2021. Global consumption was estimated at 64 kT in 2021, putting current lithium supplies in deficit. Global consumption is expected to reach 2 MTa by 2030 for an average annual growth in demand of approximately 13.5%. Supply is currently forecast to run behind demand, and lithium prices currently outstrip even the most optimistic forecasts. While lithium prices are quite volatile as the global market develops, lithium prices are expected to remain high through 2030. The incentive for more lithium production could not be clearer.

Lithium extraction from brine has become a favored method of lithium recovery. The brines from which lithium is now commonly extracted have a number of impurities, including monovalent and divalent metal ions. Improving the efficiency of lithium recovery from brine requires improved management of impurity content for cost-effective lithium recovery.

SUMMARY

Embodiments described herein provide a method of recovering lithium from an aqueous lithium source, comprising extracting lithium from an aqueous lithium source using an extraction stage to yield a lithium intermediate; routing the lithium intermediate to a concentration stage to yield a lithium concentrate; and adjusting parameters of the extraction stage to target a ratio of lithium ions to impurity ions in the eluate.

Other embodiments described herein provide a method of recovering lithium from an aqueous lithium source, comprising extracting lithium from an aqueous lithium source using an ion withdrawal extraction stage to yield a lithium intermediate; routing the lithium intermediate to a concentration stage to yield a lithium concentrate; modeling the extraction and concentration stage to define process targets for the extraction and concentration stage; and adjusting parameters of the ion withdrawal extraction stage, based on the process targets, to target a ratio of lithium ions to impurity ions in the lithium intermediate.

BRIEF DESCRIPTION OF THE DRAWINGS

FIG. 1 is a schematic process diagram of a lithium recovery process, according to one embodiment.

DETAILED DESCRIPTION

Direct lithium extraction processes are processes that extract lithium from an aqueous source, including a lithium-bearing aqueous source such as a brine. Such direct lithium extraction processes may use a selective ion removal (or withdrawal) process, or an electrochemical process, to extract the lithium. The ion removal process is selective in that it removes lithium ions more readily than other ions, thus permitting a separation and concentration of lithium ions. A lithium-bearing solution is contacted with a selective ion withdrawal medium that withdraws ions from the solution, and withdraws lithium more readily than other ions. The withdrawal medium can be a liquid and/or a solid, and can take the form of a membrane, a solid bed, or a liquid interdispersed with the lithium-bearing solution. A second fluid is used to recover the withdrawn ions from the withdrawal medium. In some cases, the process is an adsorption process where ions are adsorbed from a lithium-bearing solution onto the surface of a solid adsorbent material that is selective to lithium. A desorbent solution is then used as the second fluid to recover the withdrawn ions, yielding a lithium intermediate. In other cases, the process is an absorption process where ions are absorbed from the brine solution into the bulk of a solid absorbent material that is selective to lithium. A desorbent solution is used in these cases, as well. These cases of pure sorption-desorption can require regeneration of the withdrawal medium because unloading of ions from medium is not always quantitative.

Direct lithium extraction processes can also use a lithium selective electrochemical separation process. The lithium selective electrochemical separation process uses an electrochemical potential gradient to drive materials through a lithium selective membrane to separate lithium from an aqueous lithium source. The aqueous lithium source is brought into contact with a first side of the lithium selective membrane, and an aqueous eluent material is brought into contact with a second side of the lithium selective membrane, opposite from the first side. The voltage bias is applied within the aqueous lithium source and the aqueous eluent material to form an electric field within both materials and extending across the lithium selective membrane. The electric field provides a driving force to move, or increase movement of, charged species through the lithium selective membrane. The species motivated by the electric field to move through the lithium selective membrane depends on the configuration of the lithium selective membrane. For example, the lithium selective membrane may selectively pass lithium ions more than other ions or the lithium selective membrane may selectively block passage of lithium ions more than other ions.

Direct lithium extraction processes that include lithium selective electrochemical separation processes use lithium selective membranes. Such membranes can include, or be made of, lithium selective materials such as lithium aluminum germanium phosphate, lithium aluminum titanium phosphate, lithium lanthanum titanates, or a metal organic framework type material such as UiO-66 with acid and amine groups. Such materials can be configured alone in a membrane structure or can be added to a support material, such as a resin, configured into a membrane structure.

The ion withdrawal processes can be ion exchange or ion replacement processes in some cases, where the withdrawal medium is pre-loaded with ions, and those ions are replaced by ions from the lithium-bearing solution. The recovery process can also be an ion exchange or ion replacement process. In these cases, the withdrawal medium is prepared by loading with replacement ions prior to contact with the lithium-bearing solution. In other cases, the ion withdrawal and recovery process can be a fluid replacement process, where the withdrawal medium is a first fluid used to withdraw ions from the lithium-bearing solution by interfacial transfer from the lithium-bearing solution to the first fluid, where the first fluid is selective to lithium. A second fluid is then used to remove the ions from the first fluid by interfacial transfer from the first fluid to the second fluid. The second fluid is described as replacing the first fluid.

All these ion removal processes are performed using one or more vessels to provide contact between the lithium-bearing solution and the withdrawal medium, and then to provide contact between the loaded withdrawal medium and the second fluid during recovery processes. Composition of the second fluid is typically chosen based on an objective of the lithium extraction process. In many cases the objective is to obtain a concentrated lithium stream that can be converted to battery materials. In many such cases, the second fluid is a water stream that may be deionized or may have a low concentration of lithium ions to facilitate lithium recovery. Parameters of the second fluid, such as quantity, temperature, flow rate, and composition, can be chosen to yield a desired concentration of lithium in the eluent that can be further processed.

The withdrawal media are selective for lithium, but not exclusive, so the eluent material will have impurity ions. The selectivity of the withdrawal medium ensures that the ratio of lithium ions to impurity ions is increased in the eluent material, versus the composition of the original lithium-bearing solution. Depending on the types of processes used to yield a final product from the eluent stream, the impurity ions may need to be removed or reduced for best results. In such processes, a digital processing system executing a process targeting routine can select process targets for managing impurities most effectively.

FIG. 1 is a schematic process diagram of a lithium extraction process 100 according to one embodiment. The lithium extraction process 100 has an extraction stage 102, which can be an ion removal process, an ion withdrawal process, or a selective electrochemical process, an impurity removal stage 104, and a concentration stage 106. One type of concentration stage 106 uses a counter-flow reverse osmosis process and/or a membrane process in series to concentrate lithium, optionally in multiple stages, to yield a lithium concentrate 116. Using the counter-flow reverse osmosis process in series with a membrane process as the concentration stage 106 can produce a lithium concentrate 116 having total dissolved solids (TDS) over 120,000 mg/l, for example over 200,000 mg/l, and a dilute stream, such as the recycle 130, having TDS under 2,000 mg/l, for example under 500 mg/l. In the extraction stage 102, a lithium bearing feed stream 108 may be brought into contact with a solid or liquid material that preferentially responds to lithium, either by selectively withdrawing lithium ions from the lithium bearing feed stream 108 or by selectively passing lithium ions through a membrane. The lithium bearing feed stream 108 is typically a naturally occurring material that contains lithium and other cations, such as sodium, potassium, calcium, and magnesium, but any aqueous stream containing lithium, such as battery recycle streams, can be used. In some cases, chloride is the main anion, but other anions, such as bromide and sulfate, can be present as well. The process of the extraction stage 102 is typically staged in a vessel of some kind (not shown), and a single vessel or a plurality of vessels can be used in various arrangements that can include fixed bed and moving bed arrangements, for solid withdrawal materials, various mixing paradigms for liquid withdrawal materials, and various separation configurations for electrochemical membrane separations, with optional co-current or counter-current flow patterns in batch, semi-batch, or continuous processing modes. For example, in one case, the extraction stage 102 is an adsorption-desorption stage such as a counter-current adsorption-desorption process. Withdrawal and recovery processes can be performed in successive stages to increase the selectivity of the extraction process.

In an ion withdrawal process, the lithium bearing feed stream 108 is contacted with the withdrawal material to remove cations from the feed stream, with selectivity for lithium, along with anions. The feed stream 108 is depleted of lithium by contact with the withdrawal material, exiting the vessel as a lithium-depleted reject stream 110. The reject stream 110 may be reduced in ion content by contact with the withdrawal material, or in the case of ion replacement or ion exchange, the reject stream 110 may have an ion content that is changed by gaining ions from the withdrawal material and losing ions to the withdrawal material. The reject stream 110 typically has some concentration of all the ions that were present in the feed stream 108. The loaded withdrawal material is contacted with a volume of a recovery stream 112 to remove the withdrawn ions. The recovery stream 112 removes lithium, anions, and other cations from the withdrawal material to yield a lithium intermediate 114. As noted above, this process may be a sorption-desorption process, an ion replacement or exchange process, or a fluid replacement or exchange process, or any other process able to withdraw lithium ions from a lithium-bearing fluid using a withdrawal medium and then to recover lithium ions from the loaded withdrawal medium. Examples of these processes are known.

In an electrochemical process, direct extraction of lithium is performed by disposing the lithium bearing feed stream 108 and the recovery stream 112 on opposite sides of a lithium selective membrane and establishing an electric potential within the two fluids across the membrane. A vessel is typically divided in to two volumes by the lithium selective membrane, and a pair of electrodes, one on either side of the membrane, are immersed in the two fluids. Applying different electric potentials to the two electrodes creates an electrostatic driving force on ions within the lithium bearing feed stream 108. The voltage generally results in movement of metal cations of the feed stream 108 toward the membrane. The membrane material selectively allows lithium ions to penetrate, and may allow other metal cations to penetrate, to the recovery stream 112 on the other side of the membrane. The selectivity of the membrane increases a ratio of lithium ions to impurity ions in the recovery stream 112 relative to the feed stream 108. The ion-enriched recovery stream 112 becomes the lithium intermediate 114 in the electrochemical process, and is withdrawn from the vessel. As in the ion withdrawal process, the feed stream 108 is depleted of lithium, in this case by the action of electrostatic driving force that moves lithium ions out of the feed stream 108, to form the reject stream 110. The electrochemical process can be operated continuously using a single vessel, with feed stream 108 and recovery stream 112 continuously flowing to the vessel containing the lithium selective membrane, and reject stream 110 and lithium intermediate 114 continuously flowing out of the vessel.

The lithium intermediate 114 is typically a water stream with a concentration of lithium that is higher than the original lithium-bearing feed stream 108. Due to the selectivity of the withdrawal material or the membrane, a ratio of lithium ions to impurity ions in the lithium intermediate 114 is typically higher than the ratio of lithium ions to impurity ions in the feed stream 108. Water is removed from the lithium intermediate 114 in the concentration stage 106 to produce a lithium concentrate 116 that can be processed to convert lithium chloride to lithium materials for battery manufacturing, such as lithium carbonate and/or lithium hydroxide. Some of the most effective concentration processes involve membrane separation of one sort or another, but other concentration processes can be used.

Evaporation in one form or another can be used, instead of or in addition to membrane separation, but evaporation requires time and energy to perform, and thus can be costly. Some processes use both membrane separation and evaporation, and processes can be designed with the flexibility to use both concentration methods to varying extents depending on feed compositions and environmental conditions.

Where impurities such as sodium, calcium, and magnesium, remain in quantities that are counterproductive for further processing, those must be removed or reduced in the impurity removal stage 104, which is typically located upstream of the concentration stage 106 but may be located, alternately, downstream of the concentration stage 106 where concentrating the impurities might increase efficiency of impurity removal. In other cases where multiple concentration stages are used, the impurity removal stage 104 can be located between two concentration stages. In such cases, a first concentration stage can yield a first concentrate stream that is subjected to impurity removal in an impurity removal stage like the stage 104, which produces a purified stream. The purified stream from the impurity removal stage can then be routed to a second concentration stage for further concentration to yield a second concentrate stream. It should be noted that impurity removal can also be performed in stages where different impurities might be efficiently removed at different concentrations. In such cases, a first concentration operation can yield a first concentrate stream with composition targeted to optimize removal of a first impurity (for instance divalent impurity) to yield a first purified stream in a first impurity removal. The first purified stream can be concentrated in a second concentration operation to yield a second concentrate stream with composition targeted to optimize removal of a second impurity (for instance monovalent impurity) to yield a second purified stream in a second impurity removal. These concentration and impurity removal operations can be performed using series concentration and impurity removal stages or can be performed using single concentration and impurity removal stages operated in two modes (first concentration and impurity removal, second concentration and impurity removal).

Divalent ions, for example, can reduce the effectiveness of membrane separation processes that might be used in the concentration stage 106 because they are less soluble in water than other ions, such as lithium, and can precipitate on the membranes. Impurity removal adds cost and complexity to the process, and consumes energy, so it is desirable to minimize impurity removal. Here, a bypass 118 allows some or all of the lithium intermediate 114 to bypass the impurity removal stage 104. The impurity removal stage 104 yields an effluent 122 that is blended with the bypass 118 to form a concentrator feed 124 that is routed to the concentration stage 106. Membranes used for electrochemical ion separation in the extraction stage 102 can also be impacted by divalent ions, and may need to be flushed, backwashed, or replaced at intervals. Divalent ions may be removed using ion exchange process or electrochemical separation process using selective membrane.

The inventors have discovered that impurity levels in the lithium intermediate 114, and ratio of lithium ions to impurity ions in the lithium intermediate 114, are quite sensitive to operating conditions and configurations of the lithium extraction stage 102. For example, lithium ion throughput of a given withdrawal-recovery process, or electrochemical process, can impact concentration of lithium ions and impurity ions in the lithium intermediate 114. Increasing duration of the extraction stage, for example, typically increases ion concentration in the lithium intermediate 114 by allowing more time for separation of ions from the feed stream 108. Thus, lithium concentration in the lithium intermediate 114 can thus be adjusted by adjusting duration of the contacting in the extraction stage 102.

A controller 120 is operatively coupled to the process 100 to control operation of the process according to an objective. The controller 120 can be provided with a model routine that uses a process model to model effects of various parameters (production rate, temperature, volume of withdrawal material in use, membrane properties, compositions and flow rates of feed and recovery fluids, flow rate ratios such as feed to eluent flow rate and/or feed to recovery fluid flow rate, and voltage and/or other electrical parameters for an electrochemical process) described above, and other process and environmental variables, on process outcomes to determine targets for the process 100. The feed stream 108, the reject stream 110, the recovery stream 112, and the lithium intermediate 114 each have a respective sample point A1, A2, A3, and A4. The concentrator feed 124 also has a sample point A5. Each of the sample points A1-A5 can be coupled to an analyzer to report composition of materials sampled at the respective sample points A1-A5. Signals from the analyzer representing the compositions at the sample points can be used to monitor the processes that yield the concentrator feed 124. One analyzer can analyze the samples recovered from the sample points A1-A5, or more than one analyzer can be used. Composition of the samples from the sample points A1-A5 will vary widely as lithium is concentrated and impurities reduced, so use of multiple analyzers may simplify calibration for best accuracy. Multiple analyzers also reduce cycle time for obtaining analysis of one stream. An analyzer coupled to the sample points A1, A2, A3, A4, and A5 is operatively coupled to the controller 120, which receives signals from each analyzer representing the compositions of the feed stream 108, reject stream 110, recovery stream 112, lithium intermediate 114 and concentrator feed 124.

The model routine can also be configured to provide process targets that can achieve composition targets (i.e. using a "reverse" model). In such cases, the compositions ascertained using samples from the various sampling points can be provided to the model routine for calculation of process parameters, which can be used as process targets. The composition at the sample point A2 can also be used to detect presence of lithium, in response to which the controller 120, for example using the model routine, can be configured to calculate process parameters described herein, which can be used as process targets to minimize or eliminate lithium loss in the reject stream 110.

In one case, the model routine can be configured to provide process targets, such as temperatures, pressures, flow rates, applied voltages, durations, and the like based on a target ratio of one or more impurities to target ions, for example a ratio of wt % lithium to wt % impurity (e.g. sodium) or a ratio of wt % impurity to wt % lithium, or a target ratio of impurity ions (e.g. wt % sodium to wt % calcium). As described above, the model routine can use a physical model, a statistical model, or a combination thereof, to determine process targets to deliver a stream having the target ratio. The model routine can also use a similar model to predict such a ratio from process conditions.

In another case, the targeting routine can be configured to provide boundaries for process variables returned by the modeling routine based on external factors, such as prices of materials containing the target ions, equipment availability, costs of converting target ions to usable materials, transportation costs, environmental conditions, regulatory constraints, manufacturing constraints, and other external variables. As described above, the targeting routine can be configured as a constraint routine to bound process targets to achievable values and/or economically viable values and can include, or be configured as, an optimizer.

Where process control is based on a target ratio of impurities or a target ratio of target ions to impurities, the ratio target can be set manually by a user, or can be set by any suitably configured routine, such as any of the routines described above, or any combination thereof. For example, in one case, a user set target can be bounded by the targeting routine, which can directly change the user set target or recommend a different value to the user for the target.

Sample points can also be provided at the contacting vessel or vessels (not shown) of the extraction stage. These sample points can be used to monitor, for example, performance of the extraction process. For example, in a withdrawal process the sample points, coupled with one or more composition analyzers as described above, can be used to monitor performance of the withdrawal material, loading endpoint (i.e. ion breakthrough), unloading endpoint, and regeneration processes performed on some withdrawal materials. In an electrochemical process, the sample points, coupled with one or more composition analyzers as described above, can be used to monitor performance of the membrane. The controller 120 can be operatively coupled to one or more analyzers returning results of samples from these sample points to control the operation of the contacting vessels.

The controller 120 can be configured with a targeting routine that can determine targets for process variables such as temperatures, pressures, flow rates, number of stages of extraction, applied voltages, and the like. The targeting routine can use output of the model routine, along with a targeting model, to determine process targets that are achievable by the process 100 within given constraints, such as operating windows, equipment capabilities and availabilities, and other constraints. The targeting routine may be, or may also be, an optimizer that uses an optimization model, or a combined targeting and optimization model, to provide adjusted operating conditions of the process 100, for example the variables set forth above, to meet certain goals that can be specified and changed. The process 100 can be configured such that the controller 120 controls the analyzers to acquire and analyze samples, uses the model routine to model the process, updates the models, uses the targeting routine, and optionally the optimizer, to output process targets in a closed-loop cycle without intervention by an operator. The model routine may be a machine learning system that can apply a model of the process to calculate operating parameters. The targeting routine can also be a machine learning system that can apply process state data to determine achievable process targets. The model routine can be configured to update parameters of the models based on data from the process 100, or from other similar processes. Models used in the model routine, the targeting routine, or both can be statistical models, physical models, or combinations thereof.

The controller 120 can be configured with a yield model $Y=y(U,X)$ where Y is a yield variable to be tracked and/or controlled, such as ion concentration in the lithium concentrate 116 or the lithium intermediate 114, U is a use variable of one or more materials or resources to be used to obtain a result in the process 100, such as a feed stream rate, ion feed rate, electricity rate, and the like, and X is a process variable vector of variables such as temperature, pressure, volume of withdrawal material, membrane properties, and the like, which may include environmental parameters such as ambient temperature. The yield model can be a physical model, a statistical model, or a combination thereof, and may be linear, linearized, non-linear or a combination thereof. The yield model can be constructed from physical and/or engineering principles, or may be constructed from statistical analysis of historical data, or both. The yield model generally provides yield of results based on values of process and usage variables, and can be used to monitor and predict results of operating the process 100. The yield model can be part of the model routine or targeting routine described above, or the yield model can be implemented in a separate yield routine. The yield model may be part of a process model, a targeting model, and/or an optimization model, or the yield model may be a separate model implemented independently of other models.

The controller 120 can also be configured with a scalar realization model $R=r(U,Y,P,J)$ where P is a unit price variable and J is a unit realization variable. Realization can be defined as income minus cost, $R=I-C$, where $I=i(Y,J,Q)$ and $C=c(U,P,Q)$, Q being an optional vector of general economic parameters that may affect income and/or cost. Thus, the realization model can be constituted as $R=i(Y,J,Q)-c(U,P,Q)$. Using such models, the controller 120 could be used to monitor and predict income, cost, and realization of the process 100 based on the various use parameters U and process variables X, given market information such as the unit price vector P, unit realization variable J and economic parameters Q. The unit realization variable J may be just the unit price of lithium in one case. In another case, the unit realization variable J may be a unit price of various marketable products from the process 100, such as dilute streams and concentrate streams of various specified compositions.

The controller 120 may be further configured with change models that relate changes among the various parameters described above. Using such models, the calculation routine can predict the effects of changes in one variable on the value of another variable. For example, the model routine can predict the effect of an uncontrolled change in one variable on the value of another variable, the effect of a controlled change in one variable on the value of another variable, or the effect of controlled and uncontrolled changes in multiple variables on other variables. Where an optimizer is used, the optimizer can use the model routine to maximize or minimize one or more variables, such as realization. The change models can take the general form ∂A=(B) where B is the set of variables described above, or a subset thereof. In one example, the model routine can be configured with a set of yield change models $\partial Y/\partial U_i = y'(U,X)$, where y' will generally be a vector function that gives change in all the yield variables Y as one use variable $U_i$ changes. In some cases, these can be linearized to $\partial Y/\partial U_i = g$, where g is a constant vector. In other cases, the yield change models can be linear or non-linear models in any or all of the U and X variables. Particularly, where y is a physical model, non-linear yield change models may be used, or linearized yield change models may be used.

In one case, the income and cost models can be simple scalar product functions of a process vector and a price vector, so I=Y·J=(U,)·J and C=U·P. In this case, the realization model reduces to R=(U,)·J−U·P, and change models can take the form ∂R/∂Ui=J·y'(U,X)−P and ∂R/∂Xj=∂y/∂X·J. Change models described above can be used to predict effect of a change in a process variable, such as temperature, pressure, or feed ion concentration on the yield of lithium in the lithium concentrate 116 and the realization should that lithium be recovered to a marketable product. The change models can also be used to determine a change that can be made to a use variable, such as feed rates or electricity usage, to counteract the effect on lithium yield or realization of an uncontrolled change in another variable such as feed ion concentration or market price. For example, where yield is an inverse function of feed rate of the feed stream 108 to the extraction stage 102 and a direct function of electricity use, and where change in realization with electricity use is larger than change in realization with yield, electricity use and feed rate can be reduced to maintain lithium yield while reducing overall cost and increasing realization.

The targeting routine can take calculated process parameters from the model routine and apply any known limitations to define process targets. In cases where the model routine, the optional optimizer, and the targeting routine are separate, the targeting routine can iteratively communicate with the model routine and/or the optimizer to converge on final targets. For example, the optimizer can use the model routine to define a first set of targets that achieves an objective, the targeting routine can apply any known limitations to the first set of targets to define a second set of targets, and the optimizer can define, using the model routine and taking the second set of targets as input, a third set of targets that achieves the objective. In such cases, the optimizer can be configured with a set of optimization variables that can be adjusted to achieve the objective, while leaving the values of other variables unchanged. Thus, the optimizer and the targeting routine can communicate iteratively to converge on a set of process targets that the controller 120 can then apply to the process to move the process 100 to a new optimum operation.

The various models described above for use by the controller 120 can be configured using parameters that can be updated, occasionally or periodically, using statistical methods of analyzing historical data. Machine learning and artificial intelligence methods may be used, and multiple instances of the process 100 can supply data that is aggregated for statistical analysis.

The feed stream 108 can be sourced from a plurality of aqueous lithium sources 101 that have different compositions. These sources 101 can be a field of wells producing brine streams in some cases. A portfolio of lithium sources for one recovery process such as the process 100 can include salar brine sources, subterranean sources from wells or mines, marine sources, and various process sources, all of which can be routed to a recovery facility such as the process 100 located nearby. Each aqueous lithium source 101 can be routed to the process 100 using a flow pathway 103 with a flow controller 105 operatively coupled to the controller 120. Each source 101 has a sample point A6 coupled to an analyzer to ascertain composition of the source 101, or of material flowing from the source 101 along the respective flow pathway 103 to the process 100. The controller 120 can be operatively coupled to the analyzers of the sample points A6 and to the flow controllers 105. The controller 120 can also be operatively coupled to a flow controller 126 coupled to the recovery stream 112. The analyzers shown here can be implemented as one analyzer per sample point, or as fewer analyzers than sample points, with a sampling manifold to select among the sampling points to provide samples to the analyzers. For example, one analyzer could be manifolded to the sampling points shown in FIG. 1 using a sampler that cycles among the nine sampling points under control of the controller 120. As mentioned above, analysis cycle time and calibration range considerations may make using multiple analyzers more effective for some processes.

The controller 120 can, at times, for example periodically or on demand, recompute targets based on compositions of the sources 101 and the various process streams using one or more of the model routine, the targeting routine, and the optional optimizer. As noted above, other variables such as ambient temperature, lithium hydroxide or lithium chloride inventory, energy prices, and lithium hydroxide or lithium chloride prices can be used by the controller 120 to compute and recompute operating targets. The controller 120 may compute optimal process targets or process targets that trend toward an optimum where the optimum is not achievable or not immediately achievable.

In particular, where lithium prices are seen to be falling, the controller 120 can take measures, automatically, autonomously, or upon user direction, to reduce unit cost of the lithium chloride produced in the lithium concentrate 116, for example by controlling or reducing the use of the impurity stage 104 or bypassing the impurity stage 104 completely. Thus, a change model of the form ∂R=Yl∂Jl can be used to predict the effect of lithium price on realization, and a change model of the form ∂R=J·∂Y−P·∂Ui can be used to model the effect of changes in the various use variables. Use variables generally refer to use or non-use of certain equipment, operations, and/or stages such as impurity removal, concentration, conversion, and the like. Together, a change in use variables (i.e. whether or not to use certain equipment) can be resolved by combining the two models to give ∂Ui=(1/Pi)(J·∂Y−Yl∂Jl) for each use variable to substantially counteract the realization effect of a change ∂Jl in the price of lithium. The optimizer or targeting routine can adjust extraction conditions and rates in the extraction stage 102 to reduce impurity concentrations in the lithium intermediate 114 so that downstream processes are not substantially impacted by the impurity content, and the optimizer or targeting routine can specify a target for the bypass flow controller 128 to bypass, partially or entirely, the impurity removal stage 104. The controller 120 can tune fraction of the lithium intermediate 114 subjected to impurity removal along with impurity levels in the lithium intermediate 114, or a ratio of lithium to impurity levels in the lithium intermediate 114 by adjusting recovery fluid flow rate and/or throughput in the extraction stage 102 to reduce the incremental cost of lithium chloride produced in the concentration stage 106. The controller 120 can also select lithium sources with high and low lithium content and impurity content based on the lithium margin upgrade of the impurity stage 104 or adjust consumption of the various lithium sources to tune composition of the feed stream 108. Where impurity reduction has a large margin upgrade, for example because lithium prices are high, lithium sources with higher lithium and impurity content can be selected to drive increased production, with impurity reduction used to upgrade the lithium intermediate 114 to a minimum quality needed for concentration. Thus, impurity removal can be controlled or bypassed based on a price of lithium.

In some cases, use variables can be prioritized based on their impact on an objective. Using the models described above, the controller 120 can predict the effect of all use variables on, for example, realization, and the optimizer can be used to determine the values of use variables that optimize the process 100 according to the objective. The controller 120 can then move the process 100 to the targets in any mixture of sequential or concurrent changes. The variables predicted to have the largest impact on achieving the objective can be prioritized for immediate action and variables that have lower impact can be held constant initially while the more effective variables are changed. Such methods can be useful to minimize the chance of unpredicted disruption to the process 100 from changing too many variables at once. Such methods can also be useful to generate isolation data for specific variables to validate the predicted impact of such variables.

Periodically, occasionally, or on demand, the controller 120 can use the model routine and/or the optional optimizer to analyze the effect of variables on the results of the process 100 to update model parameters. In one example, the controller 120 can use the model routine to regress all the historical process and environmental variables together to resolve prediction parameters for a linear model that best predicts the historical results of the process. In other cases, the controller 120 can be configured to select modeling relations that give the best predictive results and then resolve parameters for the selected modeling relations. The frequency with which the models are updated can be tied to the frequency with which data is collected, taking into account time-series correlation to reduce the quantity of data to process. A user interface can be provided to change the objectives of the controller 120, for example by changing the objectives of the optimizer. For example, a user can select maximum production as an objective, or lowest unit cost, or minimum energy consumption as objectives for the optimizer. The controller 120 can be configured to display model results to a user before the result is implemented in the process 100 so the user can make any needed preparations to transition the process 100 to a new posture. For example, if the targeting routine specifies that impurity stage bypass use should move from 100% to 0% linearly over a period of three hours, the user can use a graphical interface to ascertain the targets and adjust the targets, for example to implement the reduction in bypass over a period of six hours rather than three hours, before the new process targets are implemented.

Where the extraction stage is a withdrawal process configured with a variable number of columns to contact lithium source streams with a variable quantity of adsorbents, the controller 120 can also be configured to add and remove volumes of adsorbent from the process to, for example, manage regeneration cycles of the adsorbent. The controller 120 can be configured to add pause time or idle time to operation of the extraction stage, for example by controlling switching time between vessels of withdrawal material when transitioning vessels between loading and unloading operation or between operating and regeneration phases. Extraction capacity can also be tailored by the targeting routine to adjust impurity content of the lithium intermediate 114 or lithium-impurity ratio in the lithium intermediate 114. Where the extraction stage 102 uses an electrochemical process comprising multiple independently-operable stages, the controller 120 can be configured to adjust residence times in the various stages, adjust number of stages in use, and adjust voltage (or another electrical parameter) applied to each stage to adjust impurity content of the lithium intermediate 114 or lithium-impurity ratio in the lithium intermediate 114. Because the impurity content and lithium content yielded by the extraction stage is quite sensitive to certain process variables, such as adsorbent-specific flow rate (flow rate per unit weight of adsorbent), ratio of various process streams, or liquid/solid (aqueous lithium source/withdrawal medium) relative velocity, feed TDS (ie TDS of the aqueous lithium source), feed pH (ie pH of the aqueous lithium source), pH of the recovery fluid and temperature, the controller 120 can provide strong control over lithium content, impurity content, and ratio of impurity to lithium content in the lithium intermediate 114 for optimum use of impurity removal and concentration such that brines with ratios of divalent impurities (i.e. $Mg^{2+}$ or $Ca^{2+}$) to lithium content from 1:1 up to 2000:1 can be converted to an eluent stream having impurity to lithium content ratio of 2:1 to 0.0025:1 with lithium content independently selected to be from 500 mg/1 to 6,000 mg/1, while minimizing addition of other monovalent impurities, such as Na, to reduce divalent impurities. The resulting concentrate stream can have TDS of 200,000 mg/1, 250,000 mg/1, 300,000 mg/1, or more. TDS can independently affect ion withdrawal in the extraction stage with higher levels of TDS directionally increasing ion transport rate to the withdrawal material, and vice versa.

It should be noted that the recovery stream 112 can be sourced, partially or entirely, from fluids removed and recovered in the concentration stage 106. A recycle 130 can be routed to the extraction stage 102, and can be supplemented with a make-up stream 132 or used alone for the recovery stream 112. The controller 120 can be provided with composition from a sample point A6 of the recycle 130, and can operate a flow controller 134 to control flow of the recycle 130, to adjust composition of the recovery stream 112. Use of the recycle 130 can target a ratio of impurities to lithium content in the lithium intermediate 114, and the model routine can be configured to predict the effect and output a target for the recycle 130.

Methods described herein of recovering lithium from an aqueous lithium source comprise extracting lithium from an aqueous lithium source using an extraction stage to yield a lithium intermediate; routing the lithium intermediate to a concentration stage to yield a lithium concentrate; and adjusting parameters of the extraction stage to target a ratio of lithium ions to impurity ions in the lithium intermediate.

In some cases, adjusting parameters of the extraction stage maintains the ratio of lithium ions to impurity ions in the lithium intermediate within a target range.

In some cases, the parameters include temperature, pressure, number of stages of extraction, flow rate, applied voltage, or any combination thereof.

In some cases the methods further comprise defining a target or target range of the ratio of lithium ions to impurity ions in the lithium intermediate based on a price of lithium.

In some cases, the methods further comprise subjecting the lithium intermediate to impurity removal where a ratio of lithium ions to impurity ions in the lithium intermediate reaches a selected threshold value.

In some cases, the concentration stage is a first concentration stage and wherein the method includes further subjecting the lithium intermediate to a second concentration operation before impurity removal.

In some cases, the impurity removal includes selective removal of divalent impurities. the selective removal of divalent impurities is performed using at least one of an ion exchange process and an electrochemical process.

In some cases, the methods further comprise controlling impurity removal based on a price of lithium.

In some cases controlling impurity removal comprises partially or totally bypassing the impurity removal.

In some cases the aqueous lithium source is obtained by flowing material from a plurality of brine sources, and adjusting parameters of the extraction stage includes adjusting a flow rate of the material from each of the brine sources.

In some cases the adjusting parameters of the extraction stage includes adjusting at least one of a temperature, flow rate, or composition of the aqueous lithium source.

In some cases the extracting lithium from an aqueous lithium source using an extraction stage to yield a lithium intermediate includes withdrawing lithium ions from the aqueous lithium source to a withdrawal medium in a withdrawal process and recovering lithium ions from the withdrawal medium using a recovery fluid.

In some cases the adjusting parameters of the extraction stage includes adjusting at least one of a temperature, flow rate, or composition of the recovery fluid and/or a volume of the withdrawal medium and/or a production rate of the withdrawal process.

In some cases adjusting parameters of the extraction stage to target a ratio of lithium ions to impurity ions in the lithium intermediate comprises using a model routine to predict process parameters and a targeting routine to define achievable process targets.

In some cases the model routine predicts process parameters, and the targeting routine defines achievable process parameters, as a function of the target ratio of lithium ions to impurity ions.

In some cases the extraction stage comprises a countercurrent adsorption-desorption ion withdrawal process.

In some cases the concentration stage comprises a counter-flow reverse osmosis process.

In some cases the concentration stage also yields a dilute stream, and wherein the concentration stage is configured to yield a lithium concentrate having total dissolved solids of at least 120,000 mg/l and a dilute stream having total dissolved solids not more than 2,000 mg/l.

Methods described herein of recovering lithium from an aqueous lithium source, comprise extracting lithium from an aqueous lithium source using an extraction stage to yield a lithium intermediate; routing the lithium intermediate to a concentration stage to yield a lithium concentrate; modeling the extraction and concentration stage to define process targets for the extraction and concentration stage; and adjusting parameters of the extraction stage, based on the process targets, to target a ratio of lithium ions to impurity ions in the lithium intermediate.

In some cases the modeling the extraction and concentration stage comprises using a machine learning system having a defined objective.

In some cases the extracting lithium from an aqueous lithium source using an extraction stage to yield a lithium intermediate is an ion withdrawal stage and comprises contacting a feed of the aqueous lithium source with a withdrawal medium contained in at least one vessel to add lithium ions to the withdrawal medium and then contacting a recovery fluid with the loaded withdrawal medium to remove lithium ions from the withdrawal medium.

In some cases the adjusting parameters of the ion withdrawal extraction stage includes adjusting at least one of a temperature, flow rate, or composition of the aqueous lithium source, a temperature, flow rate, or composition of the recovery fluid, volume or type of the withdrawal medium, production rate of the ion withdrawal extraction stage, ratio of feed flow rate to lithium intermediate flow rate, ratio of feed flow rate to recovery fluid flow rate, aqueous lithium source/withdrawal medium relative velocity, idle time of vessels of the ion withdrawal extraction stage, feed TDS, feed pH or pH of the recovery fluid.

In some cases the extraction stage is an electrochemical extraction stage, optionally having a plurality of stages. The electrochemical process may include flowing a feed of the aqueous lithium source and a recovery fluid on opposite sides of a lithium selective membrane and establishing an electric potential between the feed and the recovery fluid.

In some cases the extraction stage is an electrochemical extraction stage, optionally having a plurality of stages. The electrochemical process may include flowing a feed of the aqueous lithium source and a recovery fluid on opposite sides of a lithium selective membrane and establishing an electric potential between the feed and the recovery fluid.

In some cases the adjusting the parameters is done in a closed-loop cycle.

In some cases the modeling the extraction and concentration stage to define process targets for the extraction and concentration stage comprises using a model routine to predict process parameters and a targeting routine to define achievable process targets.

In some cases the model routine uses process variables, use variables and environment variables to predict process parameters.

In some cases the modeling the extraction and concentration stage to define process targets for the extraction and concentration stage further comprises using an optimizer to determine optimum process targets.

In some cases the modeling the extraction and concentration stage to define process targets for the extraction and concentration stage further comprises using the optimizer and the targeting routine iteratively to determine optimum process targets. In some cases the extraction stage is an electrochemical extraction stage, optionally having a plurality of stages. The electrochemical process may include flowing a feed of the aqueous lithium source and a recovery fluid on opposite sides of a lithium selective membrane and establishing an electric potential between the feed and the recovery fluid.

In some cases, adjusting parameters of the electrochemical extraction stage includes adjusting at least one of a temperature, flow rate, or composition of the aqueous lithium source, a temperature, flow rate, or composition of the recovery fluid, electric potential difference, production rate of the electrochemical extraction stage, ratio of feed flow rate to recovery fluid flow rate, ratio of feed flow rate to lithium intermediate flow rate, feed TDS, feed pH or pH of the recovery fluid.

In some cases the extraction stage is an electrochemical extraction stage, optionally having a plurality of stages. The electrochemical process may include flowing a feed of the aqueous lithium source and a recovery fluid on opposite sides of a lithium selective membrane and establishing an electric potential between the feed and the recovery fluid.

In some cases the parameters include temperature, pressure, number of contacting stages in the extraction stage, flow rate, applied voltage, or any combination thereof.

In some cases the modeling the extraction and concentration stages comprises using a machine learning system.

We claim:

1. A method of recovering lithium from an aqueous lithium source, comprising:

extracting lithium from an aqueous lithium source using an extraction stage to yield a lithium intermediate;

routing the lithium intermediate through an impurity removal stage in response to a ratio of lithium ions to impurity ions in the lithium intermediate reaching a predefined threshold value, wherein the impurity removal stage yields a purified lithium intermediate;

determining at least one economic factor related to lithium recovery;

bypassing at least a portion of the lithium intermediate around the impurity removal stage in response to the at least one economic factor;

routing at least one of the purified lithium intermediate or the portion of the lithium intermediate that is bypassed around the impurity removal stage to a concentration stage to yield a lithium concentrate; and adjusting parameters of the extraction stage to control the ratio of lithium ions to impurity ions in the lithium intermediate.

2. The method of claim 1, wherein adjusting the parameters of the extraction stage maintains the ratio of lithium ions to impurity ions in the lithium intermediate within a target range.

3. The method of claim 1 or 2, wherein the parameters include a temperature of the aqueous lithium source, a pressure of the aqueous lithium source, a composition of the aqueous lithium source, a number of stages of extraction, a flow rate of the aqueous lithium source, an applied voltage, or any combination thereof.

4. The method of claim 1 or 2, further comprising defining a target or target range of the ratio of lithium ions to impurity ions in the lithium intermediate based on a price of lithium.

5. The method of claim 1, wherein the at least one economic factor comprises a price of lithium.

6. The method of claim 1, wherein the aqueous lithium source is obtained by flowing material from a plurality of brine sources, and adjusting the parameters of the extraction stage includes adjusting a flow rate of the material from each brine source of the plurality of brine sources.

7. The method of claim 1, wherein the extraction stage comprises an ion withdrawal extraction stage that includes withdrawing lithium ions from a feed derived from the aqueous lithium source via a withdrawal medium contained in at least one vessel in a withdrawal process and recovering the lithium ions from the withdrawal medium using a recovery fluid.

8. The method of claim 7, further comprising adjusting at least one of a temperature of the aqueous lithium source, a flow rate of the aqueous lithium source, a composition of the aqueous lithium source, a temperature of the recovery fluid, a flow rate of the recovery fluid, a composition of the recovery fluid, a volume of the withdrawal medium, a type of the withdrawal medium, a production rate of the ion withdrawal extraction stage, a ratio of feed flow rate to lithium intermediate flow rate, a ratio of feed flow rate to recovery fluid flow rate, an aqueous lithium source/withdrawal medium relative velocity, an idle time of the at least one vessel of the ion withdrawal extraction stage, a feed total dissolved solids (TDS), a feed pH, or a pH of the recovery fluid.

9. The method of claim 7, wherein the ion withdrawal extraction stage includes a counter-current adsorption desorption process.

10. The method of claim 1, further comprising modeling the extraction stage and the concentration stage to define process targets for the extraction stage and the concentration stage.

11. The method of claim 10, wherein modeling the extraction stage and the concentration stage comprises using a machine learning system.

12. The method of claim 1, further comprising extracting the lithium from the aqueous lithium source includes using an electrochemical process, wherein the electrochemical process includes flowing a feed of the aqueous lithium source and a recovery fluid on opposite sides of a lithium selective membrane and establishing an electric potential between the feed and the recovery fluid.

13. The method of claim 12, further comprises adjusting at least one of a temperature of the aqueous lithium source, a flow rate of the aqueous lithium source, a composition of the aqueous lithium source, a temperature of the recovery fluid, a flow rate of the recovery fluid, a composition of the recovery fluid, an electric potential difference, a production rate of the electrochemical process, a ratio of feed flow rate to recovery fluid flow rate, a feed total dissolved solids (TDS), a feed pH, or a pH of the recovery fluid.

14. The method of claim 1, wherein the concentration stage comprises a counter-flow reverse osmosis process.

15. The method of claim 1, wherein the concentration stage yields a dilute stream, and wherein the concentration stage yields the lithium concentrate having total dissolved solids of at least 120,000 mg/l and the dilute stream having total dissolved solids not more than 2,000 mg/l.

16. The method of claim 1, wherein the concentration stage is a first concentration stage and wherein the method includes further subjecting the lithium intermediate to a second concentration operation before the impurity removal stage.

17. The method of claim 1, wherein the impurity removal stage removes divalent impurities.

18. The method of claim 17, wherein the impurity removal stage comprises at least one of an ion exchange process or an electrochemical process.

19. The method of claim 1, wherein:

the extraction stage comprises a counter-current adsorption-desorption ion withdrawal process comprising withdrawing lithium ions from a feed derived from the aqueous lithium source via a withdrawal medium contained in at least one vessel and recovering the lithium ions from the withdrawal medium using a recovery fluid;

the parameters of the extraction stage comprise at least one of a temperature of the aqueous lithium source, a flow rate of the aqueous lithium source, a composition of the aqueous lithium source, a temperature of the recovery fluid, a flow rate of the recovery fluid, a composition of the recovery fluid, a volume of the withdrawal medium, a type of the withdrawal medium, a production rate of the ion withdrawal process, a ratio of feed flow rate to lithium intermediate flow rate, a ratio of feed flow rate to recovery fluid flow rate, an aqueous lithium source/withdrawal medium relative velocity, an idle time of the at least one vessel, a feed total dissolved solids (TDS), a feed pH, or a pH of the recovery fluid;

the impurity removal stage removes divalent impurities using at least one of an ion exchange process or an electrochemical process;

the concentration stage comprises a counter-flow reverse osmosis process and a membrane process arranged in series to yield the lithium concentrate having total dissolved solids of at least 200,000 mg/l and a dilute stream having total dissolved solids not more than 500 mg/l; and the method further comprises:

modeling, via a controller, the extraction stage and the concentration stage using a machine learning model routine to define process targets for the extraction stage and the concentration stage; and determining, via the controller, the at least one economic factor via a scalar realization model utilizing at least one of a unit price of lithium or a unit realization variable.

20. The method of claim 1, wherein:

the extraction stage comprises an electrochemical process comprising flowing a feed of the aqueous lithium source and a recovery fluid on opposite sides of a lithium selective membrane and establishing an electric potential between the feed and the recovery fluid;

the parameters of the extraction stage comprise at least one of a temperature of the aqueous lithium source, a flow rate of the aqueous lithium source, a composition of the aqueous lithium source, a temperature of the recovery fluid, a flow rate of the recovery fluid, a composition of the recovery fluid, an electric potential difference, a production rate of the electrochemical process, a ratio of feed flow rate to recovery fluid flow rate, a feed total dissolved solids (TDS), a feed pH, or a pH of the recovery fluid;

the impurity removal stage removes divalent impurities using at least one of an ion exchange process or an electrochemical process;

the concentration stage comprises a counter-flow reverse osmosis process and a membrane process arranged in series to yield the lithium concentrate having total dissolved solids of at least 200,000 mg/l and a dilute stream having total dissolved solids not more than 500 mg/l; and the method further comprises:

modeling, via a controller, the extraction stage and the concentration stage using a machine learning model routine to define process targets for the extraction stage and the concentration stage; and determining, via the controller, the at least one economic factor via a scalar realization model utilizing at least one of a unit price of lithium or a unit realization variable.

* * * * *